US009371158B2

(12) United States Patent
Larson

(10) Patent No.: US 9,371,158 B2
(45) Date of Patent: Jun. 21, 2016

(54) LIQUID LAUNDRY PRODUCT HAVING A WINDOW FOR VIEWING

(71) Applicant: The Procter & Gamble Company, Cincinnati, OH (US)

(72) Inventor: Signe Christina Larson, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 209 days.

(21) Appl. No.: 14/314,481

(22) Filed: Jun. 25, 2014

(65) Prior Publication Data

US 2015/0375900 A1 Dec. 31, 2015

(51) Int. Cl.

| | |
|---|---|
| ***B65D 85/00*** | (2006.01) |
| ***B65D 25/56*** | (2006.01) |
| ***B65D 25/20*** | (2006.01) |
| ***B65D 25/38*** | (2006.01) |
| ***B65D 77/04*** | (2006.01) |
| ***B65D 65/18*** | (2006.01) |
| ***B65D 23/08*** | (2006.01) |
| ***B65D 1/02*** | (2006.01) |

(52) U.S. Cl.

CPC ..... *B65D 25/56* (2013.01); *B65D 1/0207* (2013.01); *B65D 1/0215* (2013.01); *B65D 23/0828* (2013.01); *B65D 23/0871* (2013.01); *B65D 23/0878* (2013.01); *B65D 25/205* (2013.01); *B65D 25/38* (2013.01); *B65D 65/18* (2013.01); *B65D 77/04* (2013.01); *B65D 85/70* (2013.01); *B65D 2201/00* (2013.01)

(58) Field of Classification Search

CPC .... B65D 25/56; B65D 25/205; B65D 25/207; B65D 1/0215; B65D 65/18; C11D 10/042; C11D 10/045

USPC ..... 206/459.1, 459.5, 497, 581; 40/310, 40/312; 215/365, 366; 510/108, 337

See application file for complete search history.

(56) References Cited

U.S. PATENT DOCUMENTS

| | | | | |
|---|---|---|---|---|
| 3,744,658 | A | 7/1973 | Fujio | |
| 3,880,311 | A * | 4/1975 | McPhee | A61J 1/05 215/365 |
| 4,444,354 | A * | 4/1984 | Staelgraeve | B65D 5/28 206/459.5 |
| 5,135,125 | A * | 8/1992 | Andel | A61M 5/1417 40/310 |
| 6,179,125 | B1 * | 1/2001 | Kvitrud | B65D 1/02 206/459.1 |
| 2007/0095721 | A1 | 5/2007 | Davis et al. | |
| 2007/0102316 | A1 * | 5/2007 | Van Der Krogt | B65D 21/0202 206/459.5 |
| 2008/0015135 | A1 | 1/2008 | de Buzzaccarini et al. | |

(Continued)

FOREIGN PATENT DOCUMENTS

EP 2 332 453 A1 6/2011

OTHER PUBLICATIONS

International Search Report for International Application Serial No. PCT/US2015/037370, mailed Sep. 21, 2015, 12 pages.

*Primary Examiner* — Luan K Bui
(74) *Attorney, Agent, or Firm* — Gary J. Foose

(57) ABSTRACT

A laundry product that is a container and a liquid laundry composition contained in the container. The primary label face has text that is substantially upright when the container is resting on the closed end of the container. The secondary label face has text that is substantially up-side-down when the container is resting on the closed end of the container. The secondary label face has a window through which the liquid laundry composition within the container can be observed from outside the container.

17 Claims, 9 Drawing Sheets

(56) References Cited

U.S. PATENT DOCUMENTS

2009/0019741 A1* 1/2009 Schwartz ..... G09F 23/00 40/312
2010/0326867 A1 12/2010 Fresnel
2014/0151258 A1* 6/2014 Vadhar ..... B32B 27/08 206/497
2014/0183078 A1* 7/2014 Newton ..... B65D 23/085 206/459.5
2014/0353196 A1* 12/2014 Key ..... G09F 3/0288 206/459.1
2015/0203236 A1* 7/2015 Etesse ..... B29C 49/04 206/459.5

* cited by examiner

LIQUID LAUNDRY PRODUCT HAVING A WINDOW FOR VIEWING

FIELD OF THE INVENTION

Liquid laundry product.

BACKGROUND OF THE INVENTION

Many consumers are frustrated by their experience in handling the packaging for liquid laundry products. Liquid laundry products are typically designed to be dispensed by pouring, pumping, or tap dispensing from a container.

One of the problems that consumers encounter is getting all of the liquid out of the container. For containers that are dispensed by pouring, the interior surface of the container can retain an appreciable amount liquid laundry detergent via surface tension. This can result in consumers not being able to use all of the liquid provided in the container. For pump dispensers, unless the pump inlet is located in a sump, it can be difficult to extract all of the liquid from the container. For tap dispensers, it can be difficult for consumers to judge how much product is remaining so as to gauge when repurchase is required.

With these limitations in mind, there is a continuing unaddressed need for liquid laundry products that can be completely dispensed and provide an indicator to a consumer when repurchase is desirable.

SUMMARY OF THE INVENTION

A laundry product comprising: a container; and a liquid laundry composition contained in said container; wherein said container comprises: a closed end having a closed end periphery; and a translucent peripheral wall extending from said closed end periphery about a longitudinal axis of said container to an open end; and a substantially opaque over layer; wherein said over layer comprises a primary label face comprising text that is substantially upright when said container is resting on said closed end, a secondary label face opposing said primary label face comprising text that is substantially up-side-down when said container is resting on said closed end, and a window in said secondary label face through which said liquid laundry composition is visible from outside said container.

DETAILED DESCRIPTION OF THE INVENTION

Figure 1:
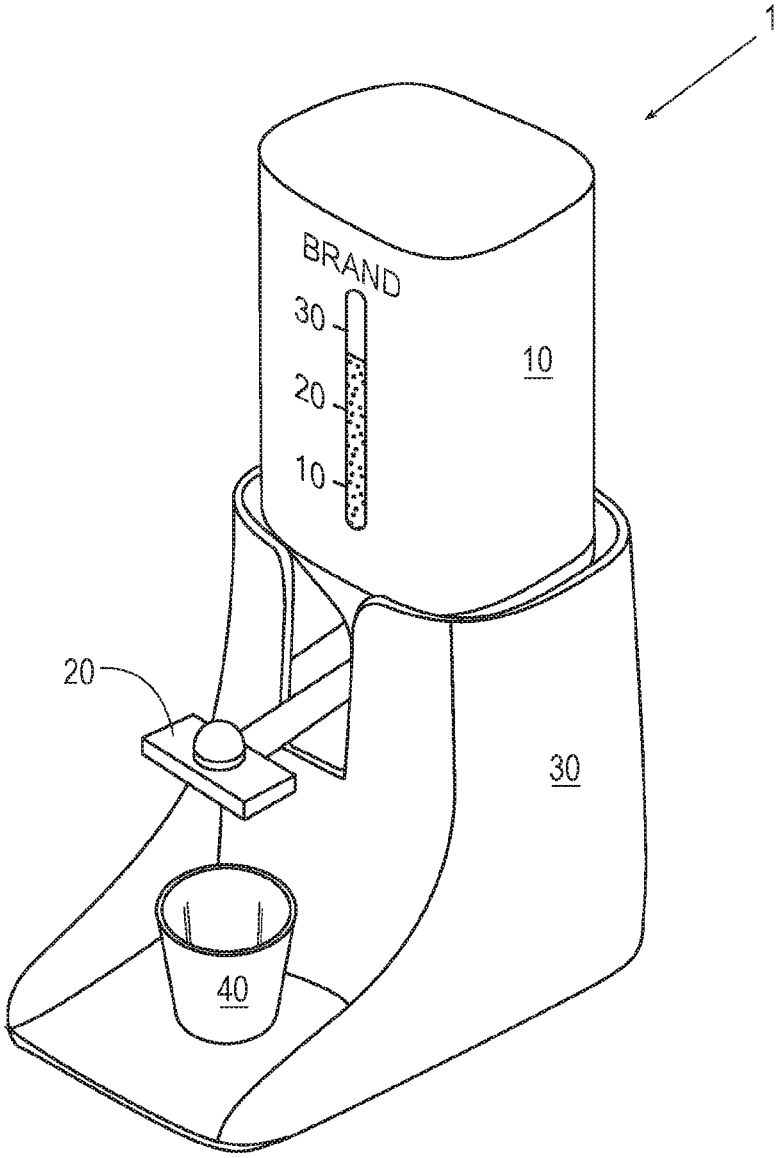
FIG. 1 is a tap dispensing system.

A tap dispensing system 1 for a liquid laundry composition is shown in FIG. 1. The tap dispensing system 1 can comprise a container 10, a tap 20 operatively engaged with the container 10, and a pedestal 30 in which the container 10 is disposed. Liquid laundry composition can be dispensed into a dosing cup 40. In use, the consumer can dispense the desired quantity of liquid laundry composition from the container 10 into the dosing cup 40 using the tap 20. The pedestal 30 can serve to elevate the container 10 so that it is convenient for the consumer to fit the dosing cup 40 underneath the tap 20. Once the consumer has dispensed the desired quantity of liquid laundry composition, she can pour the contents of the dosing cup 40 into the wash or simply toss the dosing cup 40 and contents thereof into the wash.

The consumer's experience with using the tap dispensing system 1 with a particular container 10 starts with when she determines to purchase a container 10. When she visits a store or on-line retailer, she may browse a variety of brands of liquid laundry compositions. When browsing, it is helpful to the consumer to able see on the container brand identifying nomenclature such as text or a graphic design representing the brand. In a typical product browsing environment, the containers 10 are oriented so that they are resting on the closed end of the container and the text or graphic design is oriented to be readable or recognized when the container 10 is in that orientation. For instance, the container 10 may be displayed on a shelf in a store.

The liquid laundry composition can be a liquid laundry cleaning detergent. The liquid laundry composition can be a liquid fabric softener composition. The liquid laundry composition can be a liquid stain removal composition. The liquid laundry composition can be a liquid laundry scent additive composition. The liquid laundry composition can have components selected from the group consisting of liquid laundry cleaning detergent, liquid fabric softener composition, liquid stain removal composition, liquid laundry scent additive composition, and mixtures thereof.

Figure 2:
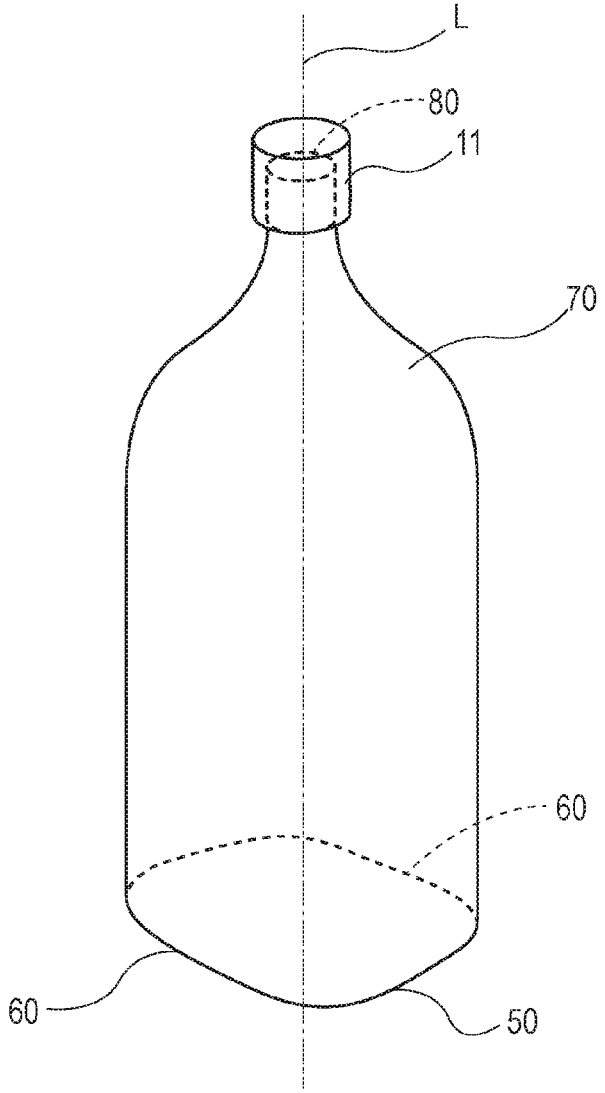
FIG. 2 is a container.

A typical container 10 of liquid laundry composition is shown in FIG. 2. In FIG. 2, the container 10 is shown to be resting on the closed end 50 of the container 10. The container 10 can comprise a closed end 50 having a closed end periphery 60. A variety of shapes for the closed end 50 are contemplated. For instance, the closed end 50 of the container 10 can have a square, rectangular, circular, or oval shaped footprint. The closed end periphery 60 defines the shape of the footprint of the container 10. The container 10 can be provided with a closure 11. The closure 11 can be a threaded cap that engages with corresponding threads proximal the open end 80 of the container 10.

The container 10 can have a translucent peripheral wall 70 extending from the closed end periphery 60 about a longitudinal axis L of the container 10 to an open end 80 of the container 10. The longitudinal axis L can pass through the open end 80. The longitudinal axis L can pass through the open end 80 orthogonal to the open end 80 of the container 10.

The container 10 can be made by extrusion blow molding, injection stretch blow molding, or other process. The container 10 can be made of a plastic material such as high density polyethylene, low density polyethylene, polypropylene, polyethylene terephthalate, or other suitable material.

The open end 80 of the container 10 can be provided with a closure 11. The closure 11 can be a cap that is engaged with the container 10 by threads in the cap that engage with corresponding threads in the container 10 proximal the open end 80 of the container 10.

The peripheral wall 70 can be translucent such that it has opacity between about 0% and about 20%. By being translucent, in certain parts of the container in which the opaque over layer 90 is absent, the liquid laundry composition within the container 10 can be seen from the exterior of the container 10. For example, the closed end 50 of the container 10 may be translucent so that the consumer can tip the container 10 and observed the liquid laundry composition through the closed end of the container 10. Without being bound by theory, it is thought that consumers enjoy seeing the product they intend to purchase and are satisfied by being able to make judgments about the quality of the product by observing the product. Suitable containers 10 can be formed from polyethylene, polyethylene terephthalate, polypropylene, and other polymers from which clear or translucent containers 10 can be manufactured. Similarly, containers 10 formed from such materials can have an opacity between about 0% and about 20% if desired.

Figure 3:
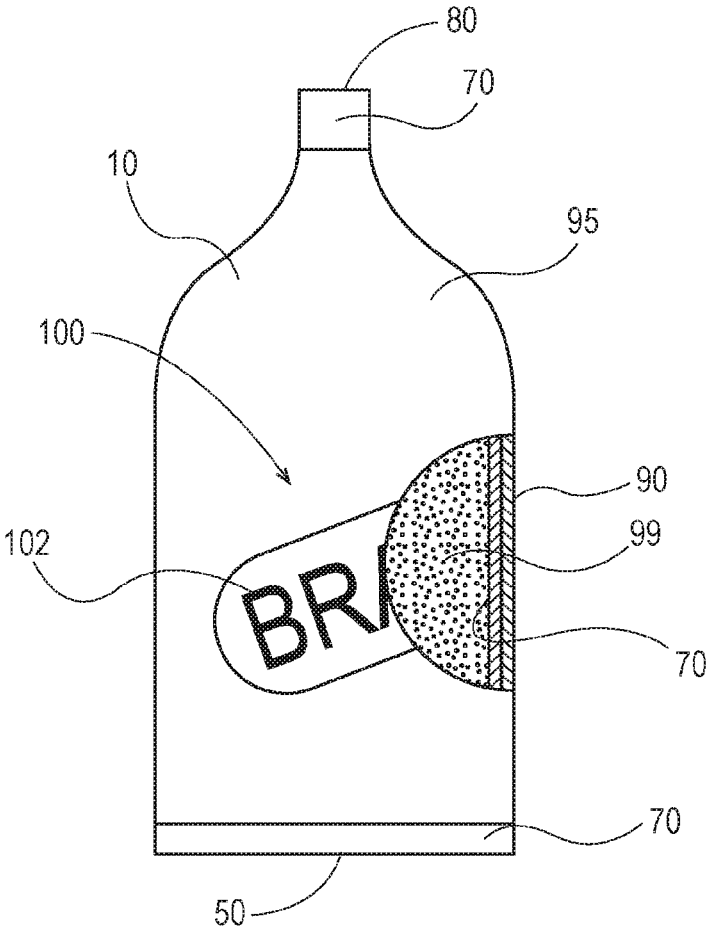
FIG. 3 is a container.

The container 10 can be provided with a substantially opaque over layer 90, as shown in FIG. 3. The over layer 90 can extend from proximal the closed end 50 to proximal the open end 80. By providing a substantially opaque over layer 90, it is thought that the color of the liquid laundry composition 99 will not interfere with visual impression of text or indicia provided on the over layer 90. The opacity of the over layer 90 can be between about 80% and about 100% if a relatively high degree of opacity is desired.

As used herein, the term "opacity" refers to the property of a substrate characterized by the capacity of the substrate to hide or obscure from view an object placed behind the substrate relative to point from which observation is made and is measured as described herein.

A substrate high in opacity will not permit much, if any, light to pass through the substrate. A substrate having low opacity will permit much, if not nearly all, light to pass through the substrate. Opacity can range from 0 to 100%.

The over layer 90 can be provided by a layer of printing on the peripheral wall 70 or a sleeve surrounding the peripheral wall. The over layer 90 can provide for a suitable background upon which indicia can be printed. The over layer 90 can be a layer of printing that is substantially opaque. The printing can be a layer of black, white, or other color that is substantially opaque. The over layer 90 can be printed upon. The over layer 90 can be thought of as being a background upon which indicia are printed. The over layer can be, by way of non-limiting example, comprised of a metallic ink or white ink. The over layer 90 can be layer of unpigmented film that through which visible light can pass. The over layer 90 can be a printed layer of unpigmented film through with visible light can pass. The over layer 90 can be a film selected from the group consisting of polyvinyl chloride film, polypropylene terephthalate glycol film, polylactide film, expanded polystyrene film, and oriented polystyrene film.

The over layer 90 can extend from the closed end 50 to the open end 80. If the over layer 90 is provided by a sleeve 95, for example a stretch sleeve or a shrink sleeve, the over layer 90 can extend from a portion of the closed end 50 to proximal or to the open end 80. For a container 10 manufactured by injection stretch blow molding, a stretch sleeve 95 can be practical. A stretch sleeve 95 is a sleeve 95 slipped over or around the pre-form from which the finished container 10 is formed. When the pre-form is blown, the stretch sleeve 95 is stretched and is in general conformance with the finished container 10. A shrink sleeve 95 is a sleeve 95 that is placed over or around the finished container 10 and is heated to shrink the sleeve 95 into conformance with the container 10.

In the practice of marketing consumer products to consumers, containers 10 are typically provided with labels. In a typical arrangement, there is a portion of the container 10 that is the primary label face 100 and a portion that is the secondary label face. The secondary label face can be opposing the primary label face 100. The front of the container 10 has the information used by consumers to identify a container 10 for selection. For example, the primary label face 100 may comprise indicia such as the brand name in large stylistic type, the weight and or volume of the liquid laundry composition 99 contained within the container 10, certain performance attributes such as "dazzling whites", certain liquid laundry composition 99 attributes such as "springtime scent," product claims such as "5 shades whiter," "tough on stains," "softness like a lamb," warning labels, and the like. In a store, the primary label face 100 is presented on the shelf to be facing the consumer at the point of selection.

The container 10 is typically presented to the consumer on a shelf. The closed end 50 of the container 10 can be resting on the shelf. Desirably, the indicia that are on the primary label face 100 are substantially upright when the container 10 is resting on the closed end. For instance, if the indicia on the primary label face 100 is text 102, the bottom of the letters may be substantially oriented towards the closed end 50 or a plane in which the closed end 50 is positioned. The top of the letters may be substantially oriented towards the open end 80 or a plane in which the open end 80 is positioned. The text 102 may be placed on a line that is at an angle to the closed end 50 and still be considered to provide for the bottom of the letters being substantially oriented towards the closed end 50 and the top of the letters substantially oriented towards the open end 80. For instance, it can be desirable to orient the text 102 to be sloping upwards from left to right, as shown in FIG. 3. As shown in FIG. 3, the top of the letters are oriented substantially towards the open end 80.

Figure 4:
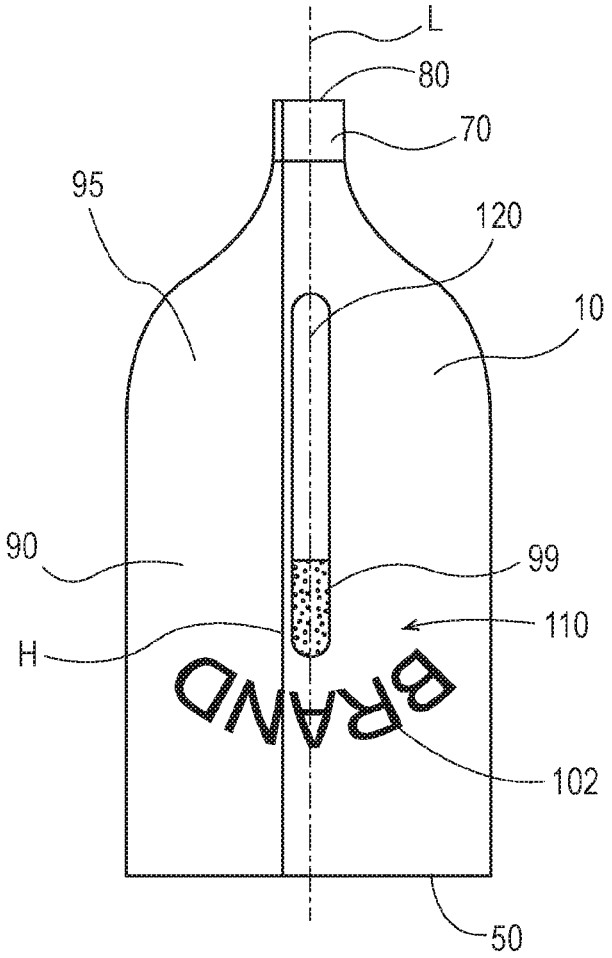
FIG. 4 is the opposite side of the container shown in FIG. 3.

The secondary label face 110 of the container 10 shown in FIG. 3 is shown in FIG. 4. The secondary label face 110 can be opposing the primary label face 100. Colloquially, the secondary label face 110 can be referred to as the back of the container 10 and the primary label face 100 can be referred to as the front of the container 10, the back of the container 10 opposing the front of the container 10. The secondary label face 110 typically has a wealth of product information, including but not limited to, the name of the manufacturer or distributor, instructions for use, dose size, warning labels, product safety information, ingredient list, information on recycling, bar coding, QRL coding, and the like.

Since the container 10 is desirably used in a tap dispensing system 1, like that shown in FIG. 1, the container 10 will be inverted during use. The open end 80 of the container 10 will be downwardly oriented and the closed end 50 of the container 10 will be upwardly oriented. This will permit the liquid laundry composition 99 to flow by gravity out of the container 10 through the tap 20 when the tap 20 is opened.

The container 10 is designed to contain multiple doses of the liquid laundry composition 99. For instance, the container 10 can contain more than about 20 doses of the liquid laundry composition 99 when the container 10 is initially purchased. In the consumer's household, the container 10 will likely be housed in a tap dispensing system 1, by way of non-limiting example like that shown in FIG. 1, over a period of several weeks. As the consumer uses the liquid laundry composition 99, she may have the opportunity to appreciate the benefits that the liquid laundry composition 99 is providing. For instance, she may recognize that her clothes are indeed whiter, smell fresher, and have fewer stains, than she experienced when she used other products.

It is thought that the pleasurable experience of using the liquid laundry composition 99 and observing superior results is an opportune time for the marketer of the container 10 to reinforce brand identifying information with the consumer. In a typical container 10, the primary label face 100 and the secondary label face 110 are oriented in the same direction. Most often, the text 102 on the primary label face 100 and the secondary label face 110 is oriented such that the text 102 is upright when the container is resting on the closed end 50. Arranged as such, it can be convenient for the consumer to simply rotate the container 10 about the longitudinal axis L so she can read both the primary label face 100 and the secondary label face 110. That is, she can just spin the container 10 around to see both the front and the back of the container 10.

For the laundry product disclosed herein, the container 10 is presented to the consumer in an up-side-down position for an extended period of time in the consumer's household when the container 10 is mounted in the tap dispensing system 1. Thus, it can be desirable to provide information on the secondary label face 110 that is right side up to the consumer when the liquid laundry composition 99 is being dispensed from the container 10.

To accomplish this objective, the secondary label face 110, which opposes the primary label face 100, can have text 102 that is substantially up-side-down when the container 10 is resting on the closed end 50. When the consumer inverts the container 10 to position it in the tap dispensing system 1, the text 102 on the secondary label face 110 will be oriented such the consumer can readily read the text 102. For instance, if the indicia on the secondary label face 110 is text 102, the top of the letters may be substantially oriented towards the closed end 50 or a plane in which the closed end 50 is positioned. Similarly, the bottom of the letters may be substantially oriented towards the open end 80 or a plane in which the open end 80 is positioned.

When the container 10 is installed in a tap dispensing system 1, the container 10 can be positioned so that the secondary label face 110 is oriented towards the consumer in use. Also, the over layer 90 can comprise a window 120 in the secondary label face 110 through which the liquid laundry composition 99 is visible from outside the container 10. The window 120 can be completely bounded by the over layer 90.

When the container 10 is positioned in the tap dispenser 1, the container 10 will be oriented such that the closed end 50 of the container 10 is above the open end 80. As the liquid laundry composition 99 is drained out of the container 10, the level of the liquid laundry composition 99 in the container 10 is lowered. The window 120 through the over layer 90 can permit the user of a tap dispenser 1 to observe the liquid level within the container 10. By seeing the liquid level, the consumer can estimate how many loads of laundry can be done before the contents of the container 10 are exhausted. By knowing such information, the consumer can determine when she needs to purchase a new container 10 so that she will avoid the situation of having loads of laundry that need done and not having enough liquid laundry composition 99 available to finish all of the loads.

As shown in FIG. 4, the container 10 can have a height H. The height H is measured orthogonally from the closed end 50 to the open end 80.

Figure 5:
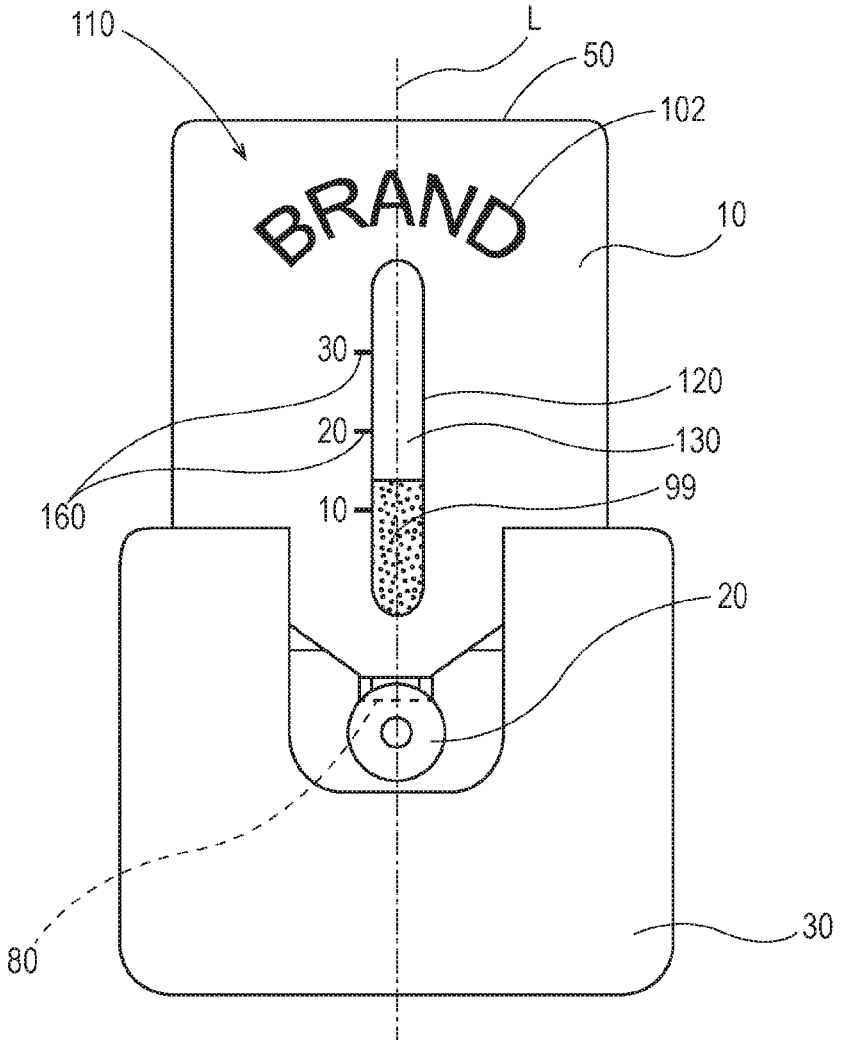
FIG. 5 is a container disposed with a tap dispensing system.

A container 10 installed in a tap dispensing system 1 is shown in FIG. 5. As shown in FIG. 5, each time the consumer uses the tap dispensing system 1, she can see the secondary label face 110 and indicia thereon which will help her remember information that can help her select the right product in the store when she has consumed all or nearly all of the liquid laundry composition 99 in the container 10. On the reverse side of the container 10 shown in FIG. 5, is the primary label face 100.

Desirable aspects of the laundry product disclosed herein include that the container 10 has a primary label face 100 providing visual presence of the container 10 in the store at the point of product selection, a secondary label face 110 providing visual presence of the container 10 in the consumer's home during use, and window 120 that provides an indicator to the consumer of how much liquid laundry composition 99 remains in the container 10.

The components of many liquid laundry compositions 99 are purported to be susceptible to photo-degradation. As such it can be desirable to minimize the surface area of the container 10 through which visible light and ultraviolet light can pass. The over layer 90 can provide a barrier to or impede the transmission of visible and ultraviolet light.

The over layer 90 can have an exterior facing surface area. Similarly, the window 120 can have a window area 130. The window area can be between about 1% and about 15% of the exterior facing surface area of the over layer 90. By having such a small fraction of the peripheral wall 70 being open to the transmission of visible and ultraviolet light, the potential adverse effects of photo-degradation on the liquid laundry composition 99 can possibly be limited to an acceptable level. Further, to reduce the potential adverse effects of photo-degradation on the liquid laundry composition 99 the window can extend between about 10% and about 90% of the height H of the container 10.

The window 120 can extend to a location that is about 80% of the height H away from the closed end 50. Positioning the window as such can be desirable so as to provide the window 120 proximal to the open end 80. When the container 10 is installed in a tap dispensing system 1, the last of the liquid laundry composition 99 will be dispensed from the open end 80. Thus, it can be desirable to have the window 120 proximal the open end 80 so that the consumer can observe how much liquid laundry composition 99 remains in the container 10 as she approaches using the last dose from the container. This will help her to better gauge when she needs to restock her supply of liquid laundry composition 99.

The window 120 can be substantially parallel to the longitudinal axis L. This can provide for an easy to read gauge of the amount of liquid laundry composition 99 remaining in the container 10 during use. The window 120 can have other shapes, for example an S shape, with such shapes integrated into the aesthetic design of the secondary label face 110.

The secondary label face 110 can be provided with one or more metering marks 160 adjacent the window 120. A metering mark 160 can be a short line adjacent the window 120. The meter mark 160 may be associated with a number indicating the number of doses of the liquid laundry composition 99 associated with the volume of the liquid laundry composition 99 remaining in the container 10.

Figure 6:
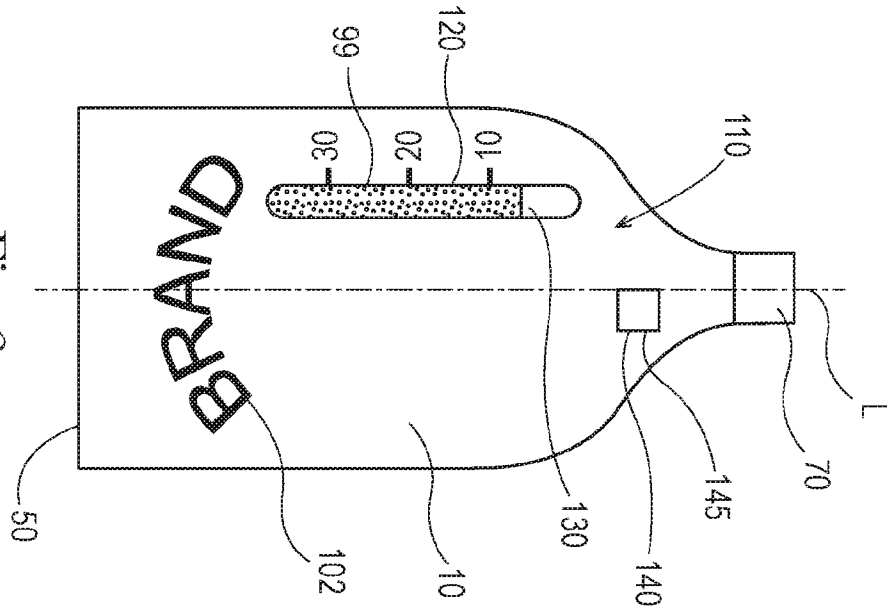
FIG. 6 is a container having a tap aligner.

In use, the consumer will attach the container 10 to a tap dispensing system 1. To help ensure that the secondary label face 110 is presented towards the consumer when the container 10 is installed in a tap dispensing system 1, the container 10 can be provided with a tap aligner 140 proximal the open end 80, as shown in FIG. 6. The tap aligner 140 can be sized and dimensioned to fit with a tap 20. The tap aligner 140 can be at a location selected from the group consisting of on the primary label face 100 proximal the open end 80, the secondary label face 100 proximal the open end 80, or other location on the container 100 proximal the open end 80. The tap aligner 140 can be fit with a corresponding tap aligner 140 on the tap 20. These features can be arranged so that the tap 20 fits onto the container 10 in only one position. That position can be the position so that when the container 10 is fitted to the tap 20, the secondary label face 110 is oriented in the direction of the tap 20. This will help ensure that the secondary label face 110 is presented to the consumer when she dispenses liquid laundry composition 99 from the container 10.

Figure 7:
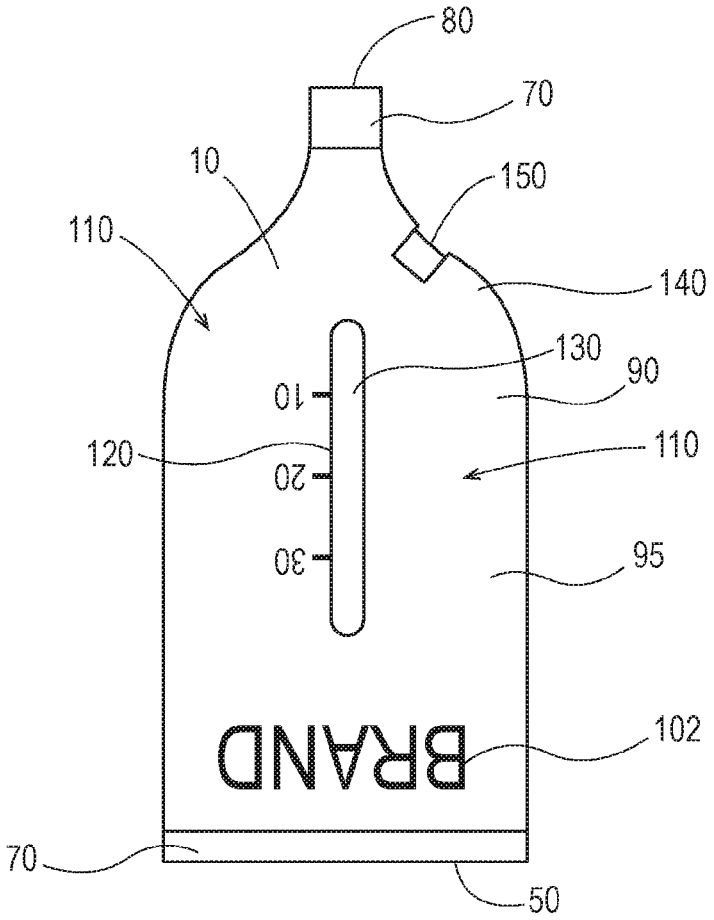
FIG. 7 is a container having a recess as a tap aligner.

The tap aligner 140 on the container 10 can be a bump 145 on the container 10, by way of non-limiting example as shown in FIG. 6. Optionally, the tap aligner 140 on the container 10 can be a recess 150 in the container 10, by way of non-limiting example as shown in FIG. 7. If the tap aligner 140 on the container 10 is a bump on the container 10, the tap aligner on the tap 20 can be a recess into which the tap aligner 140 on the container 10 fits. Similarly, if the tap aligner 140 on the container 10 is a recess 150, an example of which is shown in FIG. 7, the tap aligner 140 on the tap 20 can be a protrusion that fits with the recess 150 in the container 10.

Figure 8:
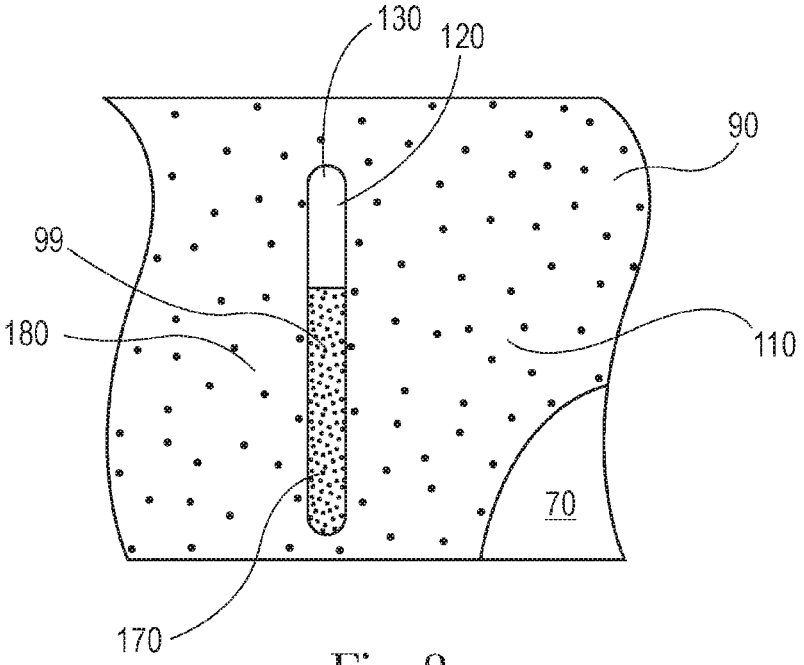
FIG. 8 is portion of a container near the window, the gradation in stippling indicative of a difference in color.

It can be desirable for the liquid laundry composition 99 as measured through said window 120 to have a first color 170 and the secondary label face 110 adjacent the window 120 to have a second color 180, by way of non-limiting example as shown in FIG. 8. The first color 170 and the second color 180 can be measured by a Reflectance Spectrophotometer according to the CIE 1976 colorspace L*, a*, and b*, wherein said first color 170 and said second color 180 have a difference in color (ΔE*) calculated using L*, a*, and b* values by the formula $\Delta E^*=[(L^*_X-L^*_Y)^2+(a^*_X-a^*_Y)^2+(b^*_X-b^*_Y)^2]^{1/2}$, wherein said ΔE* between the first color 170 and the second color 180 can be between about 10 and about 375. Without being bound by theory, it is thought that by having such a difference in color that it can be easy for the consumer to determine the level of the liquid laundry composition 99 in the container through the window 120.

A difference in color of ΔE* greater than about 10 provides a difference in color that can appear distinct to an observer. The greater the ΔE* between the first color 170 and second color 180, the more readily distinguishable the two colors are. The ΔE* between the first color 170 and second color 180 can be between about 20 and about 375. The ΔE* between the first color 170 and second color 180 can be between about 30 and about 375. The ΔE* between the first color 170 and second color 180 can be between about 40 and about 375. The ΔE* between the first color 170 and second color 180 can be between about 50 and about 375. The ΔE* between the first color 170 and second color 180 can be between about 55 and about 375. The ΔE* between the first color 170 and second color 180 can be between about 60 and about 375. The ΔE* between the first color 170 and second color 180 can be between about 65 and about 375. The ΔE* between the first color 170 and second color 180 can be between about 70 and about 375. The ΔE* between the first color 170 and second color 180 can be between about 80 and about 375. The ΔE* between the first color 170 and second color 180 can be between about 90 and about 375. The difference in color ΔE* between the first color 170 and second color 180 can be between about any number greater than or equal to 10 and about 375.

By having a ΔE* between the first color 170 and the second color 180, the liquid laundry composition 99 visually stands out from the portion of the secondary label 110 adjacent the window 120 so that the user can easily recognize the level of the liquid laundry composition 99. The first color 170 can be blue. The second color 180 can be orange. The first color 170 can be yellow. The second color can be green.

Figure 9:
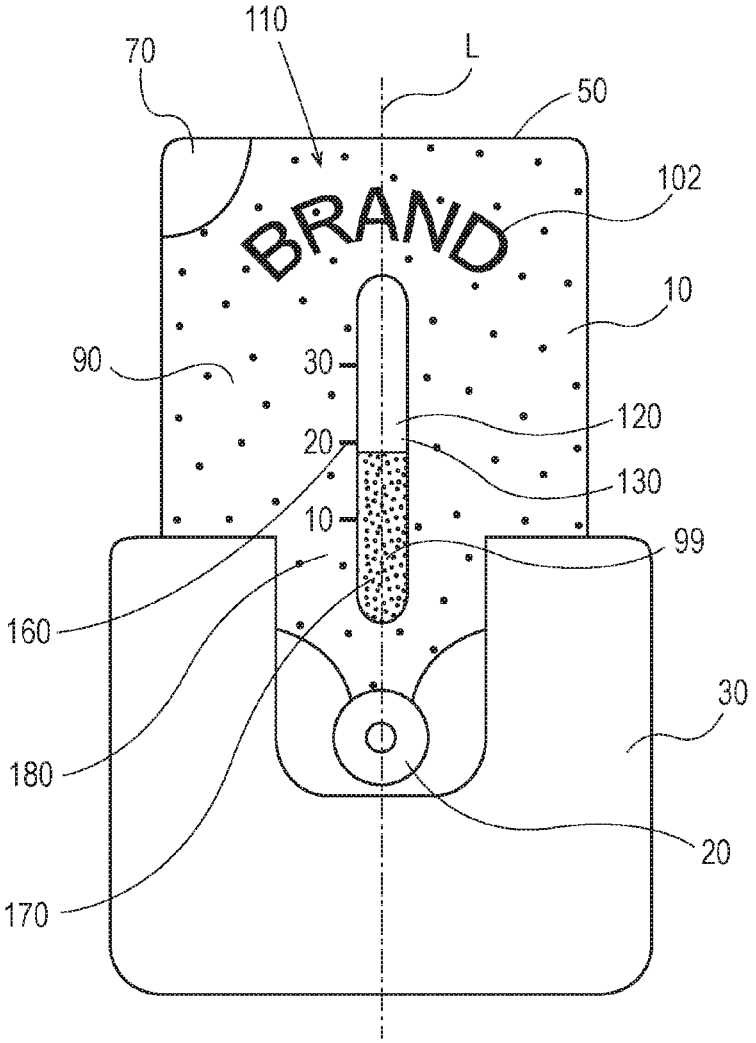
FIG. 9 is container in which the liquid laundry composition as measured through said window has a first color and said secondary label face adjacent said window has a second color.

FIG. 9 is container in which the liquid laundry composition as measured through said window has a first color and said secondary label face adjacent said window has a second color. As shown in FIG. 9, the level of liquid laundry composition 99 can differ in color from the color of the secondary label face 110 adjacent the window 120. This can make it easier for the consumer to determine the level of the liquid laundry composition 99 remaining in the container 10. To enhance the precision of the consumer's estimate of how many doses of liquid laundry composition 99 are left, meter marks 160 can be provided proximal to the window.

Color Difference Test Method

The difference in color (ΔE*) is measured using a portable reflectance spectrophotometer with a spectral range of 400 nm to 700 nm and a measurement viewing area of 5 mm in diameter. The spectrophotometer's Geometry Mode is 45°/0°, and the specular component is excluded. One suitable instrument is the Hunter Lab Miniscan EZ 4500S obtained from Hunter Associates Laboratory of Reston, Va., U.S.A. The spectrophotometer is set to the CIE 1976 Lab color scale, with D65 illuminant, and 10° Observer.

Samples are tested at an ambient temperature between 18° C. and 24° C. and a relative humidity between 50% and 80%. The spectrophotometer is calibrated prior to sample analysis utilizing the reference tiles supplied from the vendor with the instrument. Calibration is done according to the manufacturer's instructions. If cleaning is required of the reference tiles or samples, only tissues that do not contain embossing, lotion, or brighteners should be used.

The sample is tested while the container is resting upright on its closed end and fully filled with liquid composition. Since light trapped in a translucent sample can distort the color, the thickness of the sample presented to the instrument port should be chosen to maximize the color difference and the sample should be backed with a white tile placed behind the container to reduce the effects of ambient room light. Minimize directionality effects by rotating the orientation of the hand-held instrument relative to the sample (similar to the movement of the hands on a clock face) by 90° between each of four repeat measurements at each location, then average the four results. When taking measurements ensure that the sample port is lying as flat as possible against the sample surface. This may be difficult if the sample is highly curved or irregularly shaped. The first color 170 and second color 180 are measured on a surface of the over layer 90 oriented away from the peripheral wall 70.

CIE L* a* b* color measurements of the second color 180 are conducted on the secondary label face 110 at multiple locations immediately adjacent to the window 120. These measurement locations are adjacent the window 120 and evenly distributed along its perimeter, with a 10 mm spacing interval occurring between the centers of adjacent measurement locations. For measurements of the second color 180, the spectrophotometer is situated on the label such that the measurement viewing area is as close as possible to the window 120 without including any of the window 120 within the measurement viewing area. Color measurements of the first color 170 are conducted at the central point of the window 120. In some samples the window 120 may be sufficiently narrow that the diameter of the measurement viewing area does not fit wholly within the window 120 but instead includes some portion of non-window area. In such samples ensure that the viewing area is centered over the central point of the window 120 or as close to the center as possible while minimizing the portion of non-window area that is area included in the measurement viewing area, then proceed with the measurement. In some samples the curvature of the container's surface geometry may physically prevent the instrument's sample port from coming into suitable contact with the surface at some of the planned measurement locations. Such inaccessible measurement locations are to be excluded, and the measurement process continued at the next accessible measurement location.

Pairwise calculations are made between the values measured for the first color 170, and the values measured at each location for the second color 180. For each pairwise comparison, the difference in color (ΔE*) is calculated using the measured L*, a*, and b* values according to the formula $\Delta E^*=[(L^*_X-L^*_Y)^2+(a^*_X-a^*_Y)^2+(b^*_X-b^*_Y)^2]^{1/2}$, wherein 'X' and 'Y' represent the first color 170 and the second color 180, respectively. The difference in color reported for the sample is the maximum $\Delta E^*$ value obtained from the pairwise comparisons.

Opacity Test Method

As used herein, the term "opacity" refers to the property of a substrate characterized by the capacity of the substrate to hide or obscure from view an object placed behind the substrate relative to point from which observation is made. Opacity can be reported as the ratio, in percent, of the diffuse reflectance of a substrate backed by a black body having a reflectance of 0.5% to the diffuse reflectance of the same substrate backed with a white body having an absolute reflectance of 89%. Opacity can be measured as described in ASTM D 589-97, Standard Test Method for Opacity of Paper (15°/Diffuse Illuminant A, 89% Reflectance Backing and Paper Backing). The opacity of the peripheral wall is measured on material from the central third of the container as taken along the longitudinal axis L, free of any over layer.

A substrate high in opacity will not permit much, if any, light to pass through the substrate. A substrate having low opacity will permit much, if not nearly all, light to pass through the substrate. Opacity can range from 0 to 100%.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A laundry product comprising:
a container; and
a liquid laundry composition contained in said container;
wherein said container comprises:
a closed end having a closed end periphery; and
a translucent peripheral wall extending from said closed end periphery about a longitudinal axis of said container to an open end; and
a substantially opaque over layer;
wherein said over layer comprises a primary label face comprising text that is substantially upright when said container is resting on said closed end, a secondary label face opposing said primary label face comprising text that is substantially up-side-down when said container is resting on said closed end, and a window in said secondary label face through which said liquid laundry composition is visible from outside said container.

2. A laundry product according to claim 1, wherein said over layer is a sleeve.

3. A laundry product according to claim 2, wherein said liquid laundry composition as measured through said window has a first color and said secondary label face adjacent said window has a second color, wherein said first color and said second color are measured by a Reflectance Spectrophotometer Color Difference Test according to the CIE 1976 colorspace L*, a*, and b*, wherein said first color and said second color have a difference in color calculated using L*, a*, and b* values by the formula $\Delta E^*=[(L^*_X-L^*_Y)^2+(a^*_X-a^*_Y)^2+(b^*_X-b^*_Y)^2]^{1/2}$, wherein said $\Delta E^*$ between said first color and said second color is between about 10 and about 375.

4. A laundry product according to claim 3, wherein said container comprises a tap aligner proximal said open end.

5. A laundry product according to claim 4, wherein said tap aligner is a recess in said peripheral wall.

6. The laundry product according to claim 3, wherein said peripheral wall has an opacity value between about 0% and about 20%.

7. The laundry product according to claim 3, wherein said over layer has an opacity value between about 80% and about 100%.

8. A laundry product according to claim 3, wherein said over layer has an exterior facing surface area and said window has a window area, wherein said window area is between about 1% and about 15% of said exterior facing surface area.

9. A laundry product according to claim 3, wherein said container has a height measured orthogonally from said closed end to said open end, wherein said window extends less than about 90% of said height.

10. A laundry product according to claim 9, wherein said container has a height measured orthogonally from said closed end to said open end, wherein said window extends to a location that is 80% of the height away from said closed end.

11. A laundry product according to claim 1, wherein said window is substantially parallel to said longitudinal axis.

12. A laundry product according to claim 1, wherein said secondary label face comprises one or more metering marks adjacent the window.

13. A laundry product according to claim 1, wherein said container has a height measured orthogonally from said closed end to said open end, wherein said window extends less than about 90% of said height.

14. A laundry product according to claim 13, wherein said container has a height measured orthogonally from said closed end to said open end, wherein said window extends to a location that is about 80% of the height away from said closed end.

15. A laundry product according to claim 1, wherein said over layer has an exterior facing surface area and said window has a window area, wherein said window area is between about 1% and about 15% of said exterior facing surface area.

16. A laundry product according to claim 1, wherein said over layer is printing.

17. A laundry product comprising:
a container; and
a liquid laundry composition contained in said container;
wherein said container comprises:
a closed end having a closed end periphery; and
a translucent peripheral wall extending from said closed end periphery about a longitudinal axis of said container to an open end; and
a substantially opaque over layer;

wherein said over layer comprises a primary label face comprising text that is substantially upright when said container is resting on said closed end, a secondary label face opposing said primary label face comprising text that is substantially up-side-down when said container is resting on said closed end, and a window in said secondary label face through which said liquid laundry composition is visible from outside said container;

wherein said over layer is a sleeve;

wherein said liquid laundry composition as measured through said window has a first color and said secondary label face adjacent said window has a second color, wherein said first color and said second color are measured by a Reflectance Spectrophotometer Color Difference Test according to the CIE 1976 colorspace L*, a*, and b*, wherein said first color and said second color have a difference in color calculated using L*, a*, and b* values by the formula $\Delta E^*=[(L^*_X-L^*_Y)^2+(a^*_X-a^*_Y)^2+(b^*_X-b^*_Y)^2]^{1/2}$, wherein said $\Delta E^*$ between said first color and said second color is between about 10 and about 375; wherein said peripheral wall has an opacity value between about 0% and about 20%; and wherein said over layer has an opacity value between about 80% and about 100%.

* * * * *